US011278905B2

(12) United States Patent
Branton

(10) Patent No.: US 11,278,905 B2
(45) Date of Patent: Mar. 22, 2022

(54) MICROSCOPE SLIDE FILE POSITION FLAG AND METHOD RELATED THERETO

(71) Applicant: Brian Lee Branton, Palmetto, FL (US)

(72) Inventor: Brian Lee Branton, Palmetto, FL (US)

( * ) Notice: Subject to any disclaimer, the term of this patent is extended or adjusted under 35 U.S.C. 154(b) by 360 days.

(21) Appl. No.: 16/504,319

(22) Filed: Jul. 7, 2019

(65) Prior Publication Data

US 2021/0001342 A1 Jan. 7, 2021

(51) Int. Cl.
*B01L 9/00* (2006.01)

(52) U.S. Cl.
CPC ..... *B01L 9/52* (2013.01); *B01L 2300/02* (2013.01); *B01L 2300/0809* (2013.01); *B01L 2300/12* (2013.01)

(58) Field of Classification Search
CPC ..... B01L 9/52; B01L 2300/02; B01L 2300/0809; B01L 2300/12; B42F 17/00; B42F 17/02; B42F 17/06; B42F 17/12; B42F 21/00
USPC .... 206/456, 459.5; 211/10, 11, 49.1, 50, 51, 211/59.4; 220/529, 532, 533, 534; 40/380, 405, 641, 649, 654.01
See application file for complete search history.

(56) References Cited

U.S. PATENT DOCUMENTS 322,758 A * 7/1885 Smead ..... B42F 17/02 211/50
691,177 A * 1/1902 Rand ..... B42F 17/00 40/383
770,788 A 9/1904 Williamson
1,106,265 A * 8/1914 Whittle ..... B42F 17/00 40/383
1,106,396 A * 8/1914 McDonald ..... B42F 17/02 206/425
1,294,948 A 2/1918 Rand
1,485,169 A 2/1924 Crystal
1,593,210 A * 7/1926 Elliott ..... B42F 17/00 40/380
1,596,225 A 8/1926 Andersson
1,675,269 A * 6/1928 Hine ..... A47B 65/20 108/61
1,832,158 A * 11/1931 Vance ..... B42F 17/02 220/548
2,145,563 A * 1/1939 Watson ..... A47F 1/126 312/71
2,202,047 A 5/1940 Ehrlich et al.
2,559,203 A 7/1951 Weiskopf
2,619,233 A 11/1952 Weiskopf
2,668,746 A 2/1954 Weiskopf
(Continued)

*Primary Examiner* — Joshua E Rodden

(57) ABSTRACT

A flag, or marker for identifying the locations of a plurality of microscope slides once removed from a microscope slide storage system. The invention comprises a rectangular cuboid body member having front, rear, left, right, top, and bottom surfaces which substantially approximates the shape of a predefined number of microscope slides, with a recessed area with grooves to accept one slide index marker card for recording the patient's case information, or other relevant information. When multiples of the present invention are used within a microscope slide storage system, they point to locations where pluralities of microscopes slides should be returned, and provides a support structure for neighboring microscope slides within the storage location from becoming askew or broken within the microscope slide storage system.

10 Claims, 4 Drawing Sheets

(56) References Cited

U.S. PATENT DOCUMENTS 2,699,370 A 1/1955 Weiskopf
2,761,558 A 9/1956 McLean
2,801,568 A 8/1957 Dakin
2,877,773 A * 3/1959 Sewell ..... B42F 17/02 220/538
2,954,033 A * 9/1960 Marsden ..... G03B 21/54 40/380
3,140,883 A 7/1964 Anthony
3,149,892 A 9/1964 Barrow
3,227,504 A * 1/1966 Dunham ..... B42F 17/02 312/234.4
3,235,068 A 2/1966 Asnes
3,269,392 A * 8/1966 McLain ..... B42F 17/02 220/529
3,286,381 A 11/1966 Wooge
3,463,301 A 8/1969 Speelman
3,498,860 A 3/1970 Picket
3,540,786 A 11/1970 Potter
3,770,477 A 11/1973 Weichselbaum
D231,714 S 5/1974 Arthur
3,869,045 A * 3/1975 Lear ..... B42F 17/02 211/11
4,305,217 A * 12/1981 Green ..... B42F 21/00 220/535
4,369,887 A * 1/1983 Emery ..... A47F 1/12 211/126.3
4,376,610 A * 3/1983 Sofia ..... G03B 21/54 206/456
4,641,897 A * 2/1987 Long ..... B42F 17/02 206/308.3
4,763,795 A * 8/1988 Metzger ..... B42F 17/16 211/11
4,860,888 A * 8/1989 Keith ..... B65D 5/4233 206/223
4,884,692 A * 12/1989 Middlebrooks .... G11B 33/0438 206/308.3
D331,598 S 12/1992 Martin
5,312,177 A 5/1994 Coulter
5,505,315 A * 4/1996 Carroll ..... A47F 1/125 211/59.2
5,513,459 A 7/1996 Schneider
5,590,770 A * 1/1997 Yeh ..... G11B 33/0444 206/308.1
5,676,439 A 10/1997 Occhipinti et al.
5,836,098 A 11/1998 Carney
5,942,293 A 8/1999 Occhipinti et al.
6,279,299 B1 * 8/2001 Lee ..... A47B 63/00 211/51
6,354,027 B1 3/2002 Cummings
7,451,560 B2 * 11/2008 Kodde ..... G09F 1/10 211/51
7,829,028 B2 * 11/2010 Elsener ..... G01N 1/312 422/536
8,112,919 B2 * 2/2012 Borlik ..... G06Q 10/00 40/359
2005/0076038 A1 * 4/2005 Robinson ..... B42F 17/12
2008/0128428 A1 * 6/2008 Beckerman ..... B65D 25/06 220/532
2014/0123525 A1 5/2014 Payne
2021/0001342 A1 * 1/2021 Branton ..... B01L 9/52
2021/0007722 A1 * 1/2021 Branton ..... B01L 3/545

* cited by examiner

MICROSCOPE SLIDE FILE POSITION FLAG AND METHOD RELATED THERETO

BACKGROUND OF THE INVENTION

Within the field of Pathology, and more to the science of histopathology, cytopathology and microbiology, microscope slides are vital in diagnosing diseases. Each patient's medical specimen is processed by known procedural means, and affixed to a base microscope glass slide. Once all necessary processes are applied to stain the patient's specimen a cover glass is affixed over the patient's specimen, and the specimen's identification information is recorded onto the base microscope glass slide via established mechanisms. Microscope glass slides are used widely throughout other scientific fields, including but not limited to Geology, and Botany.

Other microscope slide methods previously disclosed include: Dakin U.S. Pat. No. 2,801,568 which discloses a microscope slide; Weichselbaum U.S. Pat. No. 3,770,477 which discloses a histological slide.

With Pathology, dependent upon the type of medical specimen, denotes how many microscope slides are produced from a particular patient's specimen block. The depth and breadth of histological processes employed are beyond the scope of this application. Microscopy techniques are utilized by medical personnel to review all microscope slides containing histologically prepared medical specimens. Governed by rules and regulations every single microscope slide containing a processed patient's specimen must be accounted for (hereto referred to as a specimen microscope slide), hence, medical facilities implement complicated storage, filing, and tracking systems to account for every specimen microscope slide. By utilizing industry standards, or agreed upon classification systems, once a specimen microscope slide(s) have been reviewed, and a medical determination has been made to the course of actions to follow on the patient's care, the specimen microscope slides are filed into a microscope slide storage system for future reference and referrals.

Within prior art there are three means of storing specimen microscope slides dependent upon the orientation of the slide held within. 1. Vertical orientation: Microscope slides are stored in longitudinal drawer or box type configuration providing vertical orientations, whereby the slides are inserted standing on end within the drawer or box. The vertical orientation provides quick viewing of specimen labels and easy access to slides. The specimen microscope slides are positioned front to back within rows, within each drawer or container. 2. Horizontal orientation: Containers having defined compartments where pairs of laterally spaced sidewalls for receiving slides with a removable cover which forms a box. The sides of these storage boxes contain integrated ribbing which separates the slides from one another. Specimen microscope slides are inserted horizontally into these receptacle boxes, which offers limited viewing of slide's identification labels. 3. Horizontal Flat: Where the specimen microscope slides lay flat within the slide storage devices. Many slide mailing apparatuses provide a tray device with stops to prevent slides from touching during transport. The present invention is not applicable to Horizontal Flat microscope slide storage.

Other slide filing storage systems previously disclosed include: Ehrlich/Ehrlich U.S. Pat. No. 2,202,047—Sep. 3, 1937 which disclosed a cabinet for filing microscopic slides; Weiskopf U.S. Pat. No. 2,559,203—Jul. 3, 1951 which discloses a filing cabinet; Weiskopf U.S. Pat. No. 2,619, 233—Nov. 25, 1952 which disclosed a slide filing means; Weiskopf U.S. Pat. No. 2,668,746—Feb. 9, 1954 which disclosed a filing cabinet and drawer for microscope slides; Asnes U.S. Pat. No. 3,235,068—Feb. 15, 1966 which disclosed a combination container and filing means for glass slides; Speelman U.S. Pat. No. 3,463,301—Aug. 26, 1969 which discloses a slide shipping and storage container.

In 1937, Ehrlich and Ehrlich patented the first vertically orientated slide filing cabinet designed for microscope slides, which offered higher density than the horizontal flat trays employed at that time. This design has been refined and adopted by many manufacturers today, and is still in production with only slight variations. There are other variations of vertically orientated microscope slide storage that utilizes cardboard outer boxes and internal plastic trays. In all, the microscope slide is always inserted on end, and in rows inside the drawer/tray/box/container.

With vertically oriented microscope slide storage systems a multitude of medical microscope slides are required to fill an entire drawer row. When slides are removed, the physical inclination of unsupported slides is to fall forward or backwards depending upon gravity, and other forces. A standard practice is to insert pieces of closed cell foam between or behind the slides, to provide support, to prevent the slides from laying down flat, or being broken.

With horizontal orientated slide containers specimen microscope slides are held upright and spaced with the ribbing incorporated into the sides of the containers. The incorporated ribbing provides proper spacing between slides so that the microscope slides do not fall or lay down against the neighboring slides. The container's ribbing does offer the necessary spacing of the remaining slides once a plurality of specimen microscope slides have been removed. The present invention addresses special considerations of the horizontal orientated storage containers in the detailed description section of this application.

As with all storage configurations medical librarians continually withdraw pluralities of specimen microscope slides from their respective row/drawer/box/storage locations as part of continuing patient care. The length of time at which these slides remain withdrawn is dependent upon the course of actions taken. Traditionally, when slides are removed from its storage system the librarian transcribes the particular specimen information onto a paperboard slide index marker, and this card is inserted into the area from whence the microscope slides were removed. These slide index markers are made from card stock paper, or paper board, and may incorporate preprinted lines for recording the patient's case information or the destination of the slides removed. These slide index marker cards only identify the location of the withdrawn slides and offer no support for the remaining slides within the row.

Microscope glass slides are available in a myriad of sizes and thicknesses. The standard medical microscope slides used in medical sciences commonly measures 75 mm×25 mm×1 mm or 3"×1"×1 mm, with other thicknesses offered in 1.1 mm and 1.2 mm. Glass microscope slides are typically optically clear being made from "water-white" colorless borosilicate glass, with a multitude of corner details, including 90° ground clipped corners, 45° ground corners, and 90° cut edge corners. Glass slides are offered in a plurality of treatments and designs, including, frosted or unfrosted, charged or uncharged, plain slide or prepainted slide ends for writing upon or engraving into the glass itself. Other microscope glass slides are treated with painted areas or regions specific to the type of specimen being affixed to each slide, the most common of these being a control microscope slides whereby a control specimen and the patient's specimen is affixed to the same microscope slide and processed with the procedural staining protocols. If the resulting stain produces the same positive results on both specimens, the indication points to a particular disease and would define the course of care for the patient. A multitude of other sizes of glass microscope slides are available. Some of the other standard sizes measure 76 mm×51 mm, 75 mm×50 mm, 48 mm×28 mm, and 46 mm×27 mm, and are available in other thicknesses, and are used throughout the scientific world.

In addition to the variations of microscope glass slides, the accompanying cover glass (sometimes referred to as the cover slip), is also offered in a multitude of sizes, thicknesses, and shapes, which depends upon the type of specimen previously affixed to the microscope glass slide. These variations include round cover glass in various diameters and thicknesses, and rectangular cover glass, also produced in a myriad of sizes and thicknesses, where the width of the cover glass never exceeds the width of the intended microscope glass slide.

SUMMARY OF THE INVENTION

For a further understanding of the nature, and objectives of the present invention, reference should be made to the detailed description taken in conjunction with the accompanying drawings. This invention fulfills the following roles; when a multitude of specimen microscope slides are removed from microscope slide storage systems, as a void is created by the removal of the microscope slides, the remaining slides tend to lean against the neighboring slides held within the drawer. If a sufficient number of slides are removed, the remaining slides encumber further removal of additional slides. As stated previously, slide index markers, (card stock markers), are inserted into the void created by the removal of medical slides. These cards mark the location of the withdrawn slides, but provides no physical presence to fill the void and prevent the surrounding glass slides from falling into the void. By using the invention, the microscope slide file position flag marker, the body of the invention is inserted into the void created by the removal of slides. This invention will be made in a plurality of depths, and depended upon the number of microscope slides withdrawn, the librarian would insert a corresponding sized microscope slide file position flag marker equal to the number of slides removed to fill the void. Multiple microscope slide file position flags markers can be utilized together to fill larger voids. Once the void is filled the remaining slides would safely recline against the body of the invention, thus preventing the remaining slides from falling flat or being broken. Made from brightly colored plastics, the microscope slide file position flag marker would be easily visible against the remaining slides. Once the librarian returned with the previously removed slides, the invention flagging the location, would prompt a quick return of the removed slides.

The invention, in its horizontal embodiment, would be used in the same manner within the box type storage devices, whereby the wings are inserted into the integrated ribbing against the walls of the slide storage box. The body member being sized of various depths would fill the void of multiple slides within the horizontal storage box. The invention has been sized to fit within the box type slide storage systems, whereby the lid of the box can be return to the correct location.

DETAILED DESCRIPTION OF PREFERRED EMBODIMENTS

Figure 1:
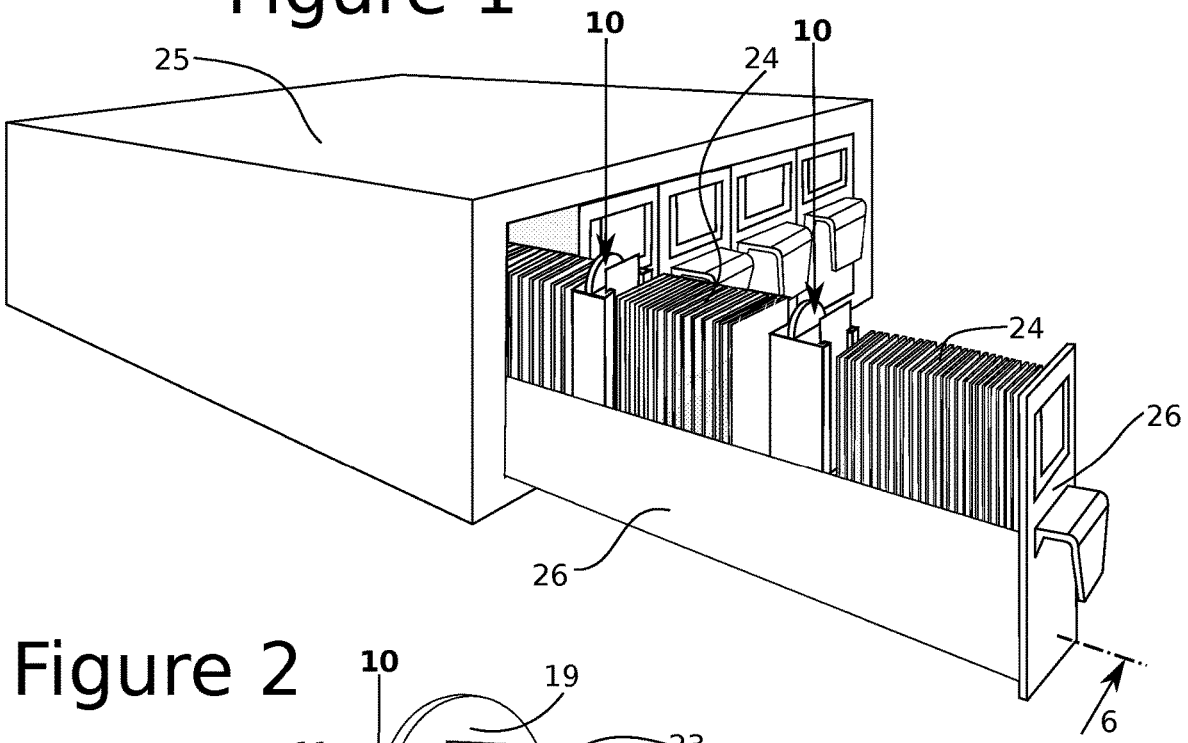
FIG. 1 is a perspective view of an exemplary embodiment of two microscope slide file position flag markers of the present invention in use with a representative vertical microscope slide storage cabinet and drawer.

Referring to the drawings, numeral (10) designates a embodiment of one microscope slide file position flag marker of the present invention in multiple images. Microscope slide file position flag marker (10) comprise a unitary rectangular cuboid block of molded plastic that measures longer in length than one microscope glass slide, narrower in width than one microscope glass slide, the depth measures equal to the thickness of a specified plurality of microscope glass slides and cover glass stacked upon one another, a integrated handle, and recessed slot or groove for one slide index marker card with the body member.

In FIG. 1 the microscope slide file position flag marker (10), is illustrated in combination with a microscope slide filing cabinet (25), positioned within a slide filing drawer (26), and the surrounding specimen microscope slides (24) contained therein. The body of the present invention (10) is inserted to fill the void created when a particular Patient's specimen microscope slides are removed from their storage location as part of the continuing patient care. Traditionally, the specimen microscope slides removed are to be reviewed by medical personnel via microscopy techniques.

Figure 2:
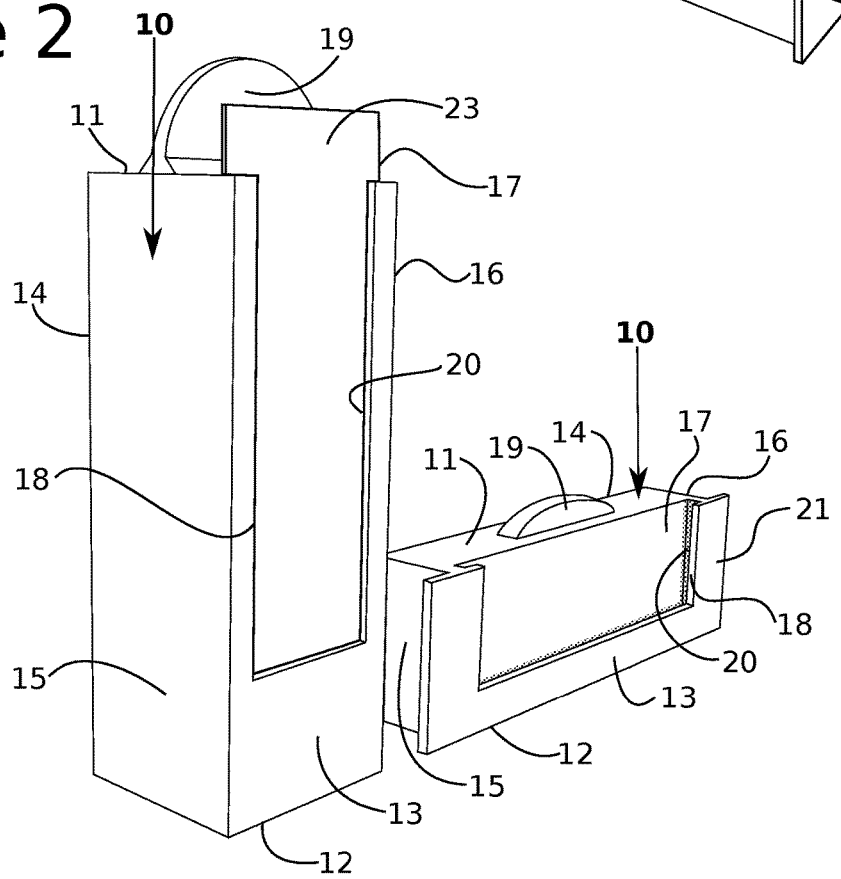
FIG. 2 is a perspective view of two embodiments of the present invention, the left shown in its vertical embodiment, the right shown in its horizontal embodiment.

Referring to FIG. 2, the microscope slide file position flag markers (10), hereto pictured as the two representations of the invention in their vertical and horizontal embodiments with preferably a rectangular top surface (11), a rectangular bottom surface (12), parallel and spaced apart from the top surface (11), a rectangular front surface (13), a rectangular rear surface (14), parallel to and spaced apart from the front surface (13), a rectangular left surface (15) a rectangular right surface (16), wherein the left surface (15) is parallel and spaced apart from the right surface (16), The front surface (13) has a rectangular area (17) displaced parallel to the front surface (13) forming the inner surface (17). Extending outwardly from the outer edges of the inner surface (17) are substantially identical ends (18) forming channels with the front surface (13), whereby these channels (20) slidably receive a slide index marker card (23) within the slot or groove, where the top surface (11) incorporates a handle (19) extending above the flag body (10), and with the horizontal microscope slide position flag marker body (10) shown illustrated on the right, has the front surface (13) extending past the left (15) and right (16) surfaces to form wing surfaces (21) that together in combination with the front surface (13) equals the overall length of the specified microscope slide being replaced.

Figure 3:
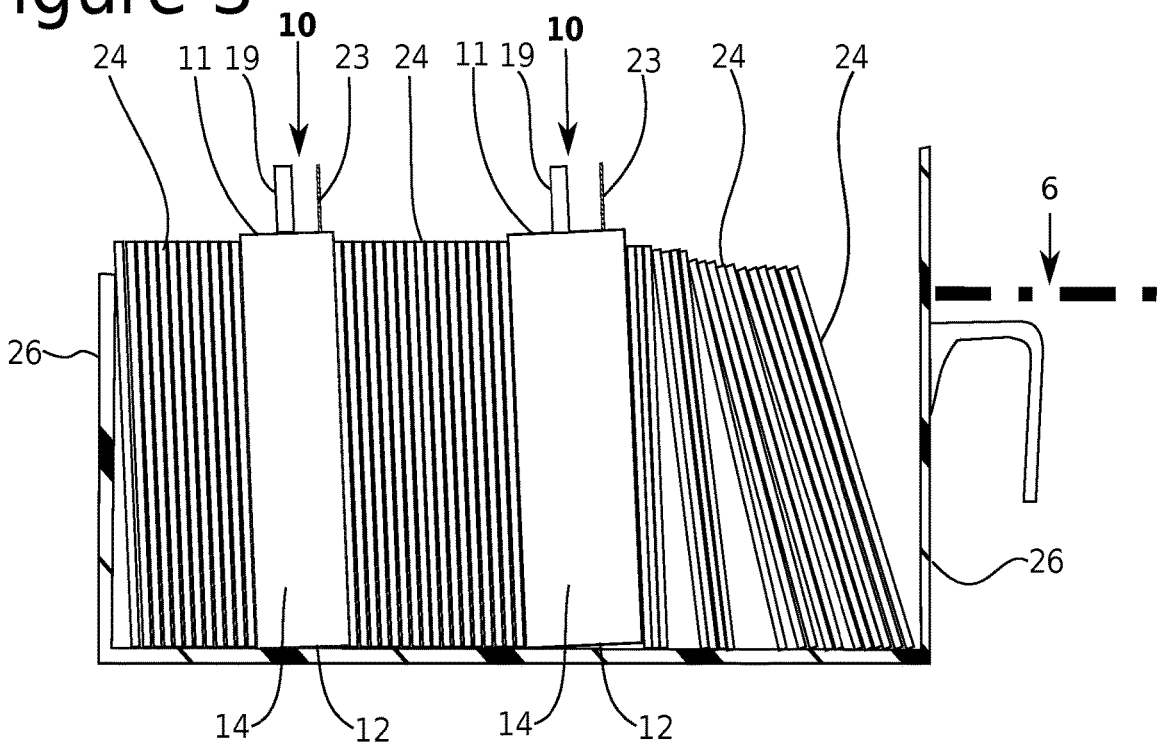
FIG. 3 is a vertical cross-sectional view of the drawer of FIG. 1 taken along line 6 which shows the remaining glass slides interaction with the present invention.

Referring to FIG. 3 illustrates a cross-sectional view of the slide drawer (26), from the slide filing cabinet (25) shown in FIG. 1, following along line (6), showing generally the contents of the file drawer, which denotes a plurality of vertically orientated specimen microscope slides (24) arranged in row in a "front to back" orientation, whereby the microscope slide file position flag marker (10) is engaged with and supporting the surrounding specimen microscope slides (24). The microscope slide file position flag marker (10) is capable of such positioning as it is not dependent upon the agreed classification systems utilized to file the specimen microscope slides within the storage system. The classification and patient's information is recorded upon the slide index marker (23), which is inserted into the groove (24) on the microscope slide file position flag marker body (10) for the represented "removed" specimen microscope slides.

Figure 4:
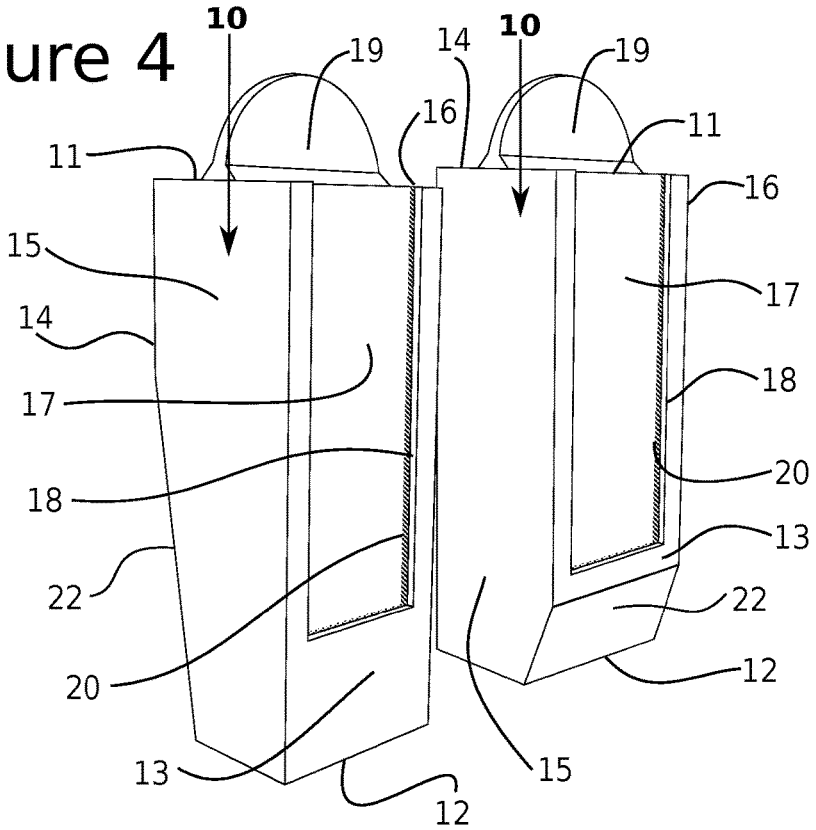
FIG. 4 is a perspective view of two vertical embodiments of the present invention, the microscope slide file position flag marker on the left has a wedged surface (22) incorporated into the rear surface (14), the microscope slide file position flag marker on the right has a wedged surface (22) incorporated into the front surface (13).

Referring to FIG. 4 illustrates variations in the vertical oriented embodiment of the present invention (10), whereby the flag marker's body represented on the left has a wedged surface (22) shape incorporated into the rear surface (14), and the representation of the flag body (10) on the right, incorporates the wedged surface (22) shape into the front surface (13) below the recessed surface (17), and the ends (18) forming the groove (20). With the addition of the wedged surface (22) variation to the present invention, reduces the bottom surface (12) allowing the flag's body (10) to be inserted into voids where the surrounding specimen microscope slides have moved within the storage drawer/box reducing the overall space or gap within the void. The wedged surface (22) shape allows the flag marker body (10) to push against the remaining microscope slides correcting the required spacing within the storage location.

Figure 5:
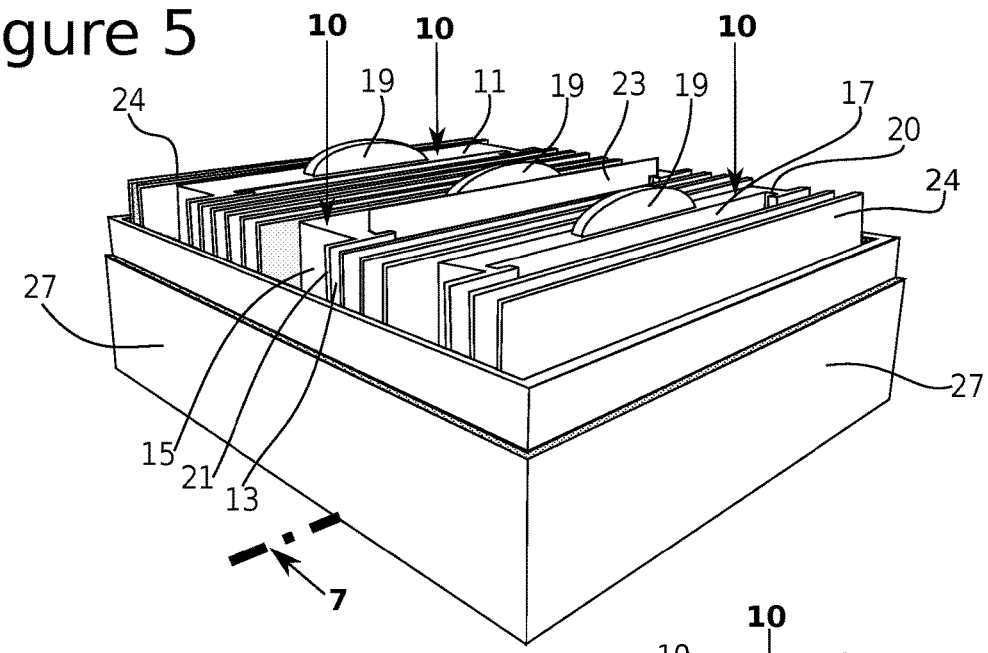
FIG. 5 is a perspective view illustrating three horizontal embodiments of the microscope slide file position flag markers inserted into a slide storage box with the remaining microscope slides pictured.

Referring to FIG. 5 illustrates a perspective view of one horizontally oriented microscope slide file storage box (27), with three microscope slide file position flag markers (10), or the present invention, of various sizes (thicknesses) in used in conjunction with other remaining specimen microscope slides. The center embodiment shown has the slide index card (23) inserted for a visual reference of the height compared to the surrounding microscope slides. Note how the front surface (13) and the wing surfaces (21) combined are of the same length as the specimen microscope slides pictured.

Figure 6:
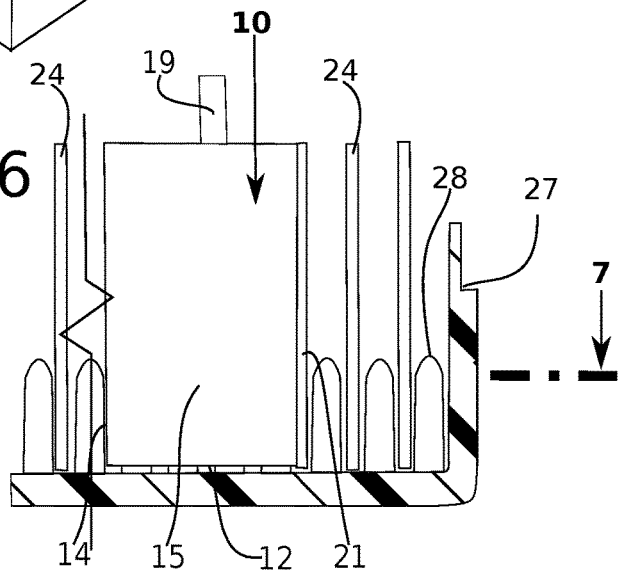
FIG. 6 is a vertical cross-sectional view of the slide storage box of FIG. 5 taken along line 7 which shows the remaining glass slides interaction with the present invention.

Referring to FIG. 6 shows a cross-sectional view of FIG. 5. taken alone line (7) illustrates the horizontal embodiment of the present invention inside the microscope slide storage box (27), which depicts the interaction of the microscope slide file position flag markers (10), and the container's integrated ribbing (28) of the slide storage box (27). Whereby the noted front surface (13) and the combined wing surfaces (21) utilize the integrated ribbing (28) of the slide storage box (27) to provide the correct spacing for the "removed" specimen microscope slides.

Figure 7:
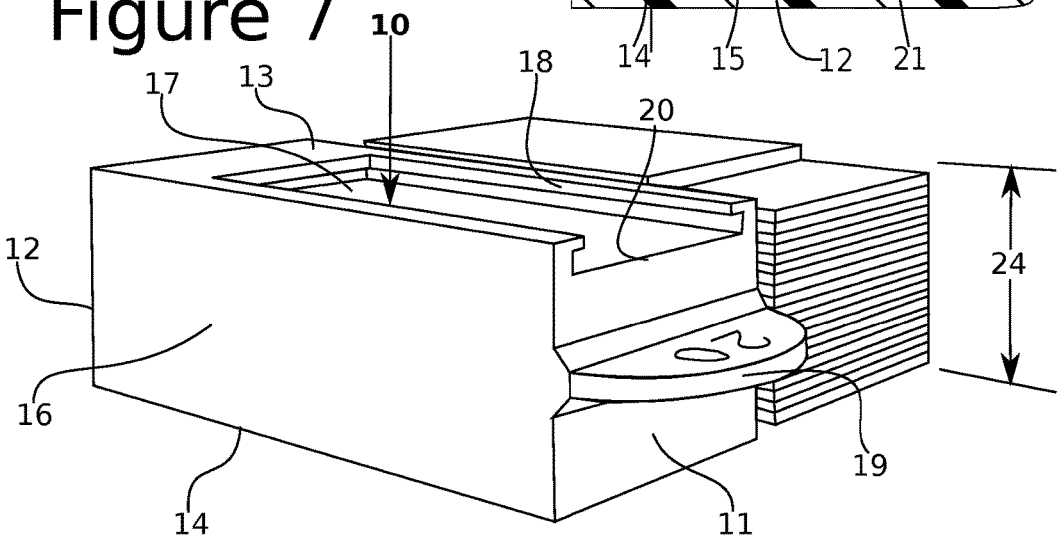
FIG. 7 is a perspective view of a vertical embodiment of the present invention, positioned upon its back surface, with a comparable stack of microscope slide and cover glass to show a comparison to the thickness of the present invention.

Referring to FIG. 7 illustrates one vertical embodiment of the present invention (10), positioned upon its back surface (12), adjacent to a representation of a corresponding stack of specimen microscope slides (24) with cover glass to provide a reference that the microscope slide file position flag marker (10) is equal to a predefined number of specimen microscope slides (24). These predefined numbers provide common thicknesses or depths for the present invention, where the thickness may equal 5, 10, 20, 25, or 50 slides with attached similarly numbers of attached cover glass. Each microscope slide file position flag marker (10) is embossed, engraved, or labeled with a number designating the thickness of slides represented by the body of the present invention.

Figure 8:
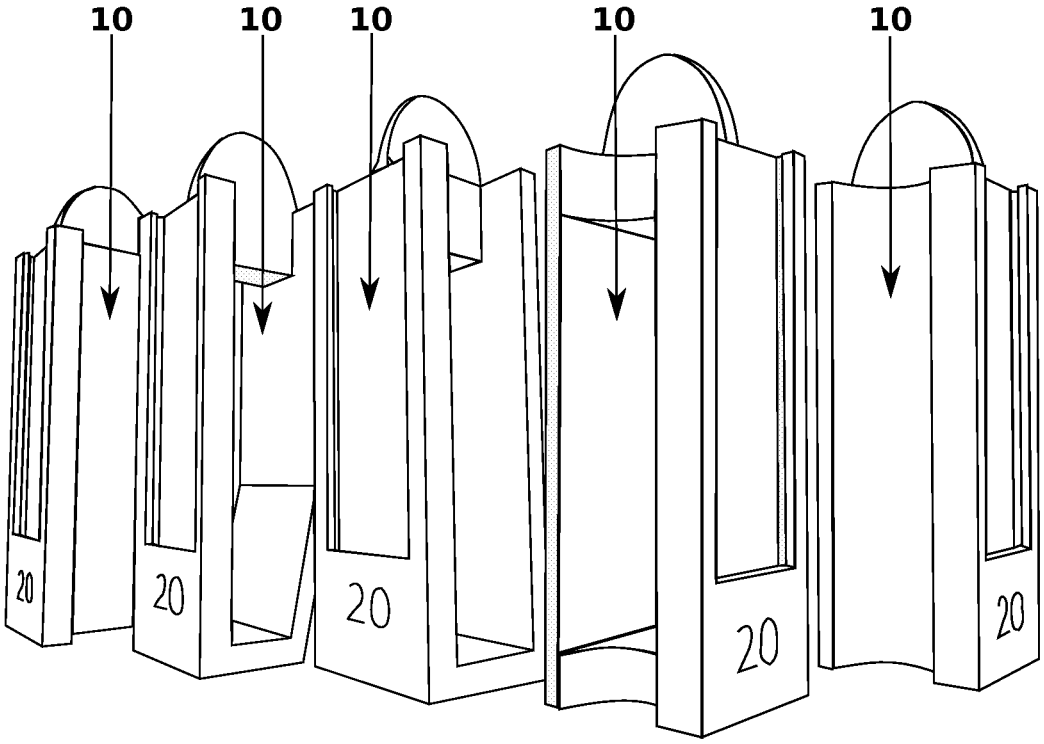
FIG. 8 is a perspective view illustrating five variations of the present invention that incorporates differences into the body member.

Referring to FIG. 8, the present invention (10) is shown in a plurality of forms where the entire body member (10) is reduced to the front surface (13), rear surface (14), bottom surface (12), recessed surface (17), groove (20) for the slide index card (23), and the handle (19). The remaining left surfaces (15), right surface (16), and top surface (11) have been reduced to minimal proportions, but remain to provide structural elements to the remaining surfaces. The five variations represented are example modifications and may not be reflected in the final embodiment.

Figure 9:
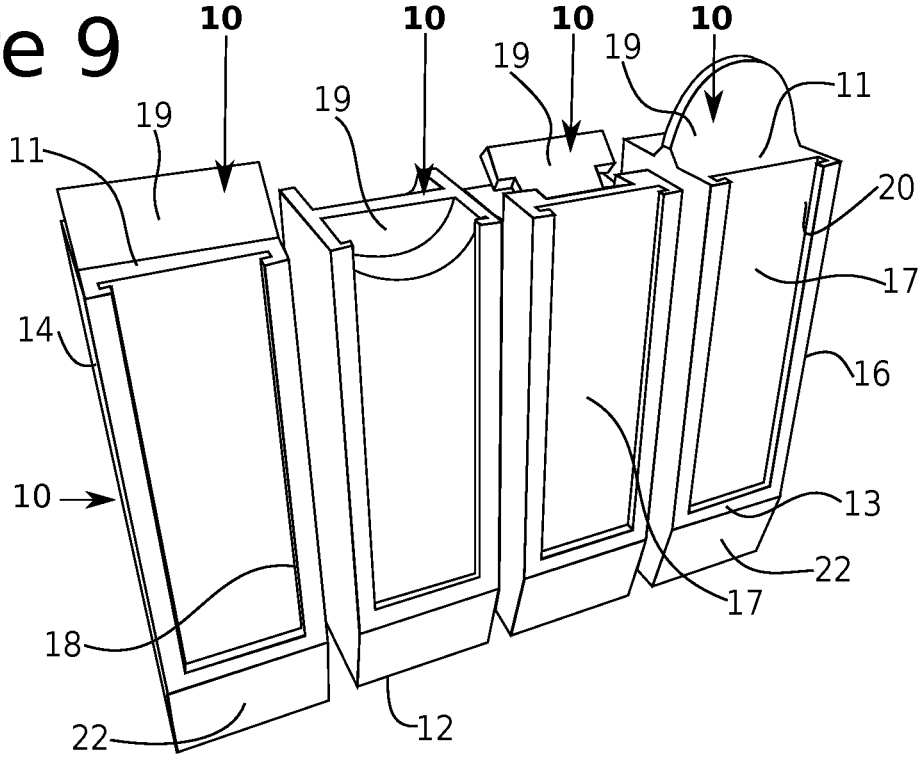
FIG. 9 is a perspective view illustrating variations of the handle element (19) for the present invention.

FIG. 9 illustrates four variations of the present invention, or body members of the microscope slide file position flag marker (10), with modifications to the handle member (19) utilized when inserting and removing the body member from a specimen microscope slide file location. The four examples shown are only a few of the conceivable variations to the handle member (19) possible, and may not reflect upon the final embodiment.

Today the universal use of microscope glass slides and cover glass utilized in multitudes of uses, designs, and functions are well beyond the scope of the present invention. It is the intent for the microscope slide file position flag marker (10) to fulfill the role in which it it has been described and detailed herein. Although the aforementioned interpretation of the present invention will be offered with variations in its design and function, the final embodiment, without departing from the spirit and scope, will universally provide a means whereby persons utilizing this invention might ultimately ease their daily routines when interacting with microscope slide storage systems, with the use of the microscope slide file position flag marker (10), as hereinafter claimed.

What is claimed:

1. A method of using a plurality of microscope slide file position flag markers comprising the steps of:

a. locating and removing a plurality of microscope slides containing mounted specimens from a location inside a microscope slide storage container held within a microscope slide storage system;

b. counting the plurality of microscope slides removed to determine the correct sized one of the plurality of flag markers needed to infill a space left by the microscope slides removed;

c. selecting the correct sized one of the plurality of flag markers roughly equal to the plurality of microscope slides removed;

d. transcribing any relevant patient information from the plurality of microscope slides removed, onto a slide index marker card, and then the slide index marker card is inserted into grooves on a face of the correct sized one of the markers;

e. inserting the correct sized one of the flag markers into the location within the microscope slide storage container, infilling the space created by removing the plurality of microscope slides;

f. returning the plurality of microscope slides to the location, by removing the correct sized one of the flag markers and inserting the plurality of microscope slides back into the location inside the microscope slide storage container.

2. The method of claim 1, where the flag markers measure substantially tall enough in height to be seen behind other microscope slides inside the microscope slide storage container.

3. The method of claim 1, where the flag markers measure substantially short enough in height that the microscope slide storage container is configured to be closed inside a microscope slide file storage cabinet.

4. The method of claim 1, where the flag markers measure substantially in height whereby the marker is configured to be seen behind other microscope slides and short enough that the microscope slide storage container is configured to be closed inside a microscope slide file storage cabinet.

5. A microscope slide file position flag marker comprising:

a. a free-standing movable marker having a rectangular cuboid shape, that substantially approximates physical dimensions of a predefined number of microscope slides with mounted specimens on each slide, positioned to stand vertically with the mounted specimens and slide label areas facing forward and up, with each slide lined up in a row;

b. the predefined number of microscope slides corresponds to a predetermined number, in the form of one of 5, 10, 20, 25, and 50;

c. a length of the marker is a distance between front and rear surfaces of the marker spaced apart that substantially approximates a physical thickness measured front to back of the predefined number of microscope slides standing vertically in a row;

d. a width of the marker is a distance between left and right surfaces spaced apart that substantially approximates a smaller measurement than a width of the microscope slides standing vertically in a row;

e. a height of the marker is a distance between top and bottom surfaces of the marker spaced apart that substantially approximates a length of the microscope slides standing vertically in a row;

f. the front surface of the markers has an area displaced and parallel to the front surface forming an inner surface, extending outwardly from opposing outer edges of the left, and right surfaces and the inner surface are substantially identically mirrored ends forming channels within the front surface, where the channel is configured to slidably receive a slide index card, making the index card visible on the front surface;

g. the top surface incorporates a handle extending above for grasping and positioning the marker inside a microscope slide file storage container;

h. the predetermined number of predefined microscope slides is embossed, engraved, or surfaced labeled with the predetermined number upon any surface of the marker.

6. A method for use of a plurality of microscope slide filing position flag markers positioned horizontally inside microscope slide storage boxes comprising:

a. locating and removing a plurality of microscope slides from a location inside one of the microscope slide storage boxes;

b. counting the plurality of microscope slides removed to determine a correct sized one of the flag markers needed to infill a space created by the removed microscope slides;

c. selecting the correct sized one of the flag markers roughly equal to the plurality of microscope slides removed;

d. transcribing any relevant patient information from the plurality of microscope slides removed, onto a slide index marker card, and then the slide index marker card is inserted into grooves on a face of the correct sized one of the plurality of markers;

e. inserting the corrected sized one of the flag markers into the location within the microscope slide storage box infilling the space created by removing the plurality of microscope slides;

f. returning the plurality of microscope slides to the location by removing the correct sized one of the flag markers and inserting the plurality of microscope slides removed back into the location inside the microscope slide storage box.

7. The method of claim 6, where the flag markers measure substantially tall enough in height to be seen behind other microscope slides inside the microscope slide storage boxes.

8. The method of claim 6, where the flag markers measure substantially short enough in height that the microscope slide storage boxes are configured to be closed.

9. The method of claim 6, where the flag markers measure substantially in height whereby the marker is configured to be seen behind other microscope slides and short enough that the microscope slide storage boxes are configured to be closed.

10. A microscope slide file position flag marker for use with microscope slide storage boxes comprising:

a. a free-standing movable marker having a rectangular cuboid shape, that substantially approximates physical dimensions of a predefined number of microscope slides with mounted specimens on each slide, positioned with the mounted specimens and slide label areas facing forward, with each slide positioned between integrated rib members inside a microscope slide storage box;

b. the predefined number of microscope slides corresponds to a predetermined number, in the form of one of 5, 10, 20, 25, and 50;

c. a length of the marker is a distance between left and right surfaces of the marker spaced apart that substantially approximates a distance across an inside bottom of the microscope slide storage box measured from one integrated rib directly across to an opposite rib that forms a slot for one microscope slide;

d. a width of the marker is a distance between front and rear surfaces of the marker spaced apart that substantially approximates a physical thickness for the predefined number of slides, plus the number of integrated ribs from inside the microscope slide storage box that the predefined number of microscope slides contacts, multiplied by a measurement for a thickness of said integrated ribs;

e. a height of the marker is a distance between top and bottom surfaces of the marker spaced apart that substantially approximates a width of the microscope slides positioned to stand horizontally;

f. the front surface extends past the left and right surfaces with opposing identical wings that extend out to approximate the length of the microscope slide when positioned horizontally, where said microscope slide would contact the integrated ribs inside the microscope slide storage boxed, and a thickness of the opposing identical wings substantially approximates the thickness of one of the microscope slides;

g. the front surface of the marker has an area parallel and displaced forming an inner surface, and extending outwardly from the outer edges of the inner surfaces form substantially identical channels within the front surface, where these channels are configured to slidably receive a slide index card, making the index card visible on the front surface;

h. the top surface incorporates a handle extending above for grasping and positioning the marker within the microscope slide storage box;

i. the predetermined number of the predefined number of microscope slides is embossed, engraved, or surfaced labeled upon any surface of the marker.

* * * * *